US006690987B2

(12) United States Patent
Baudry et al.

(10) Patent No.: US 6,690,987 B2
(45) Date of Patent: Feb. 10, 2004

(54) SYSTEM FOR PRESENTING A TEXTILE SHEET AUTOMATICALLY

(75) Inventors: Yvon Baudry, Merignac (FR); Robert Jean, Fouqueville (FR); Jean Pascal Pirodon, Villefontaine (FR)

(73) Assignee: Messier-Bugatti, Verlizy-Villacoublay (FR)

( * ) Notice: Subject to any disclaimer, the term of this patent is extended or adjusted under 35 U.S.C. 154(b) by 171 days.

(21) Appl. No.: 09/880,386

(22) Filed: Jun. 13, 2001

(65) Prior Publication Data

US 2002/0123820 A1 Sep. 5, 2002

(30) Foreign Application Priority Data

Mar. 2, 2001 (FR) ..... 01 02868

(51) Int. Cl.[7] ..... G06F 19/00; B65H 23/02; B65H 23/04

(52) U.S. Cl. ..... 700/135; 700/143; 226/15

(58) Field of Search ..... 700/143, 130, 700/135; 112/470.03, 475.03, 470.07, 304, 305, 306, 314, 320; 226/15, 2, 3, 24, 27, 28

(56) References Cited

U.S. PATENT DOCUMENTS 4,054,251 A * 10/1977 Henderson et al. ..... 226/15 X
4,610,739 A * 9/1986 Jensen ..... 226/15 X
4,790,052 A 12/1988 Olry ..... 28/110
4,962,576 A 10/1990 Minichshofer et al. ..... 28/110
5,214,828 A 6/1993 Neuert et al. ..... 28/282
5,226,217 A 7/1993 Olry et al. ..... 28/107
5,540,166 A * 7/1996 Wiley ..... 112/475.03
5,781,973 A 7/1998 Orzel ..... 26/75
6,029,327 A 2/2000 Sheehan et al. ..... 28/107

FOREIGN PATENT DOCUMENTS

| | | |
|---|---|---|
| EP | 0 493 050 A1 | 7/1992 |
| EP | 0 493 050 | 7/1992 |
| FR | 2 741 634 A1 | 5/1997 |
| FR | 2 761 380 A1 | 10/1998 |
| GB | 1 308 999 | 3/1973 |
| GB | 1 449 641 | 9/1976 |
| JP | 11-012913 | 1/1999 |
| WO | WO 97/15708 | 5/1997 |

* cited by examiner

*Primary Examiner*—Peter Nerbun
(74) *Attorney, Agent, or Firm*—Weingarten, Schurgin, Gagnebin & Lebovoici LLP

(57) ABSTRACT

Apparatus for automatically presenting a generally pre-needled textile sheet coming from an upstream module and intended to feed a cross-layer module, the apparatus comprising means for measuring the positions of the longitudinal edges of the textile sheet, means for adjusting the width of said textile sheet, means for adjusting the position of said textile sheet, and processor means responsive to the position measuring means to control the adjustment means in real time in such a manner that the textile sheet presents determined width and position.

10 Claims, 3 Drawing Sheets

SYSTEM FOR PRESENTING A TEXTILE SHEET AUTOMATICALLY

FIELD OF THE INVENTION

The present invention relates to the field of needled textile structures and it relates more particularly to a system for presenting a pre-needled textile sheet automatically at the inlet of a cross-layer.

PRIOR ART

In traditional industrial needling processes, the textile sheet for needling and that is to be used, for example, in making protective parts for use in high temperatures, is built up from a plurality of tows placed side by side and each comprising a multitude of textile yarns, advantageously of the monofilament type. This first textile sheet is generally needled briefly a first time in a pre-needling module and is then directed to a transverse inlet of a cross-layer whose longitudinal inlet receives a second textile sheet that is generally pre-needled in similar manner and that is to serve as a support onto which the pre-needled first textile sheet is to be deposited. Nevertheless, proper cross-laying assumes that the first textile sheet arrives with constant width and position that are determined with very great accuracy.

Unfortunately, at present, presentation to the transverse inlet of a cross-layer is provided solely in manual manner by an operator who constantly watches the first textile sheet and, whenever possible, modifies the position and the width thereof manually so as to ensure that the sheet is properly covered, thereby limiting defects in the final textile structure. Unfortunately, when too many defects appear, the industrial process must be interrupted with the grave consequences that stem therefrom. In particular, this method is particularly expensive in labor costs (especially when a process is run continuously 24 hours a day), and it is not free from defects due to the presence of the human factor.

OBJECT AND DEFINITION OF THE INVENTION

The present invention mitigates these drawbacks by providing apparatus for automatically presenting a generally pre-needled textile sheet from an upstream module to feed a cross-layer module, the apparatus comprising means for measuring the positions of the longitudinal edges of said textile sheet, means for adjusting the width of said textile sheet, means for adjusting the position of said textile sheet, and processor means for responding to said position measuring means to control said adjustment means in real time in such a manner that said textile sheet presents determined width and position.

With this particular configuration, it is possible automatically to obtain accurate centering of the textile sheet coming from a tow feed module or a pre-needling module and for the width and the position of the sheet at the inlet of the cross-layer to be constant in a manner that is accurately guaranteed and controlled in real time so as to ensure accurate overlapping in the final textile structure.

Advantageously, the means for measuring the positions of the longitudinal edges of the textile sheet comprise at least one detector (and preferably two detectors each disposed in register with a corresponding edge of said textile sheet), and preferably a linear optical sensor made up of a plurality of light-emitting diodes (LEDs) disposed in register with a plurality of light-receiving diodes, and with the textile sheet to be measured passing between them. Alternatively, these measuring means can be constituted by a digital camera placed above the textile sheet. Similarly, the means for adjusting the width of the textile sheet comprise a curved adjustment bar which can be pivoted about a pivot axis under the control of a lever arm by means of a first actuator which modifies the position of the curvature of the central portion of the adjustment bar, thereby acting on the width of the textile sheet passing over said curved adjustment bar.

In similar manner, the means for adjusting the position of the textile sheet comprise a second actuator acting on a support frame for the textile sheet so as to move it relative to the structure of the apparatus. The first and second actuators are preferably electrically controlled actuators that are actuated directly by said processor means.

The processor means comprise a digital computer or a programmable controller responsive to said measurements taken by said position detectors to control said first and second actuators for adjusting the width and the position of said textile sheet so as to provide real time regulation of its width and position relative to predetermined reference values previously supplied to said processor means by an operator. Advantageously, the predetermined reference values comprise the total width for the sheet Nc and the position of a longitudinal central axis of the sheet Pc.

The invention also provides a method of automatically presenting a textile sheet that is implemented in the above apparatus.

BRIEF DESCRIPTION OF THE DRAWINGS

The characteristics and advantages of the present invention will appear more clearly on reading the following description given by way of non-limiting indication and made with reference to the accompanying drawings, in which.

DETAILED DESCRIPTION OF A PREFERRED EMBODIMENT

Figure 1:
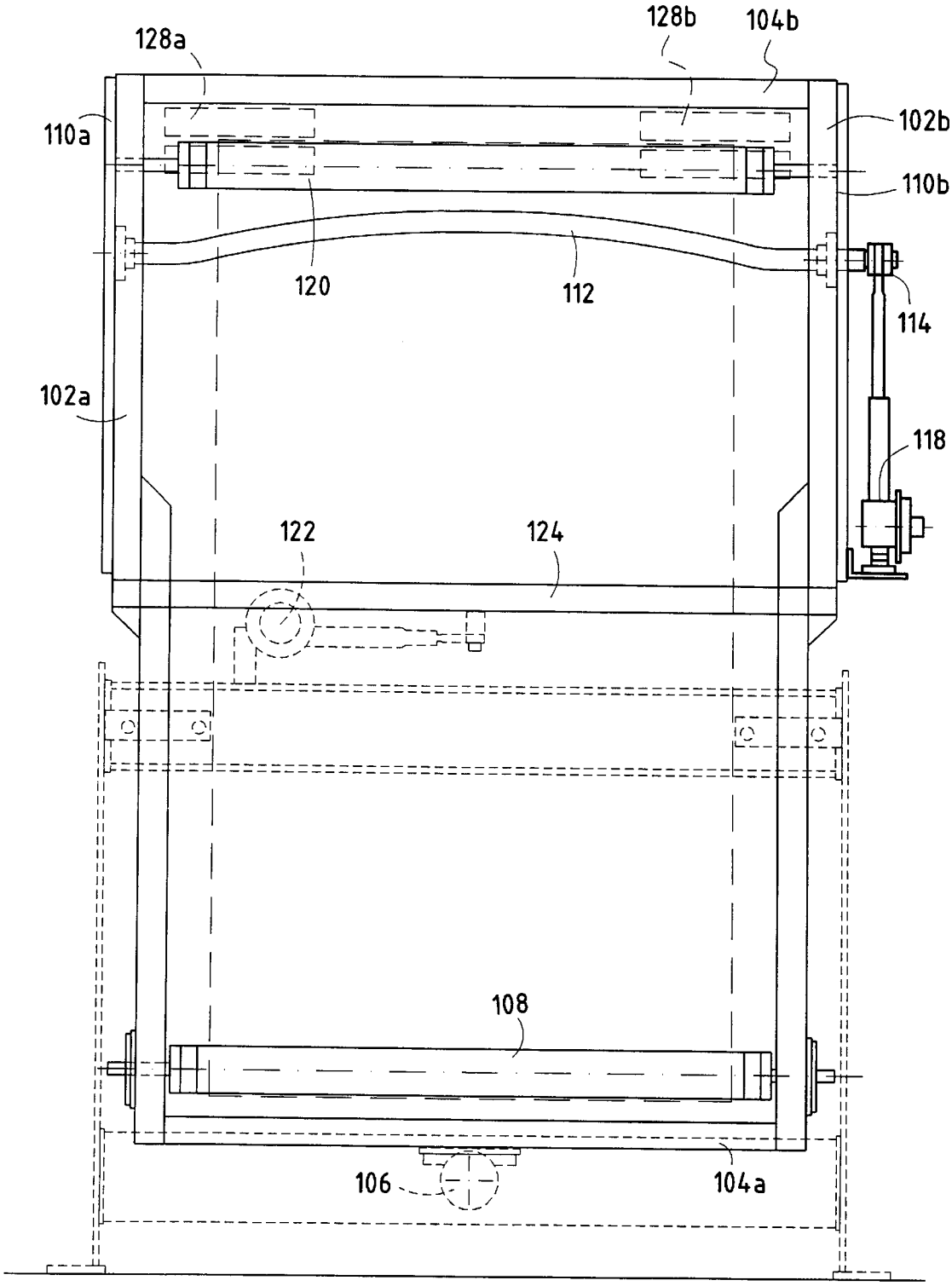
FIG. 1 is a diagrammatic elevation view of apparatus of the invention for automatically controlling the spreading of a textile sheet.
Figure 2:
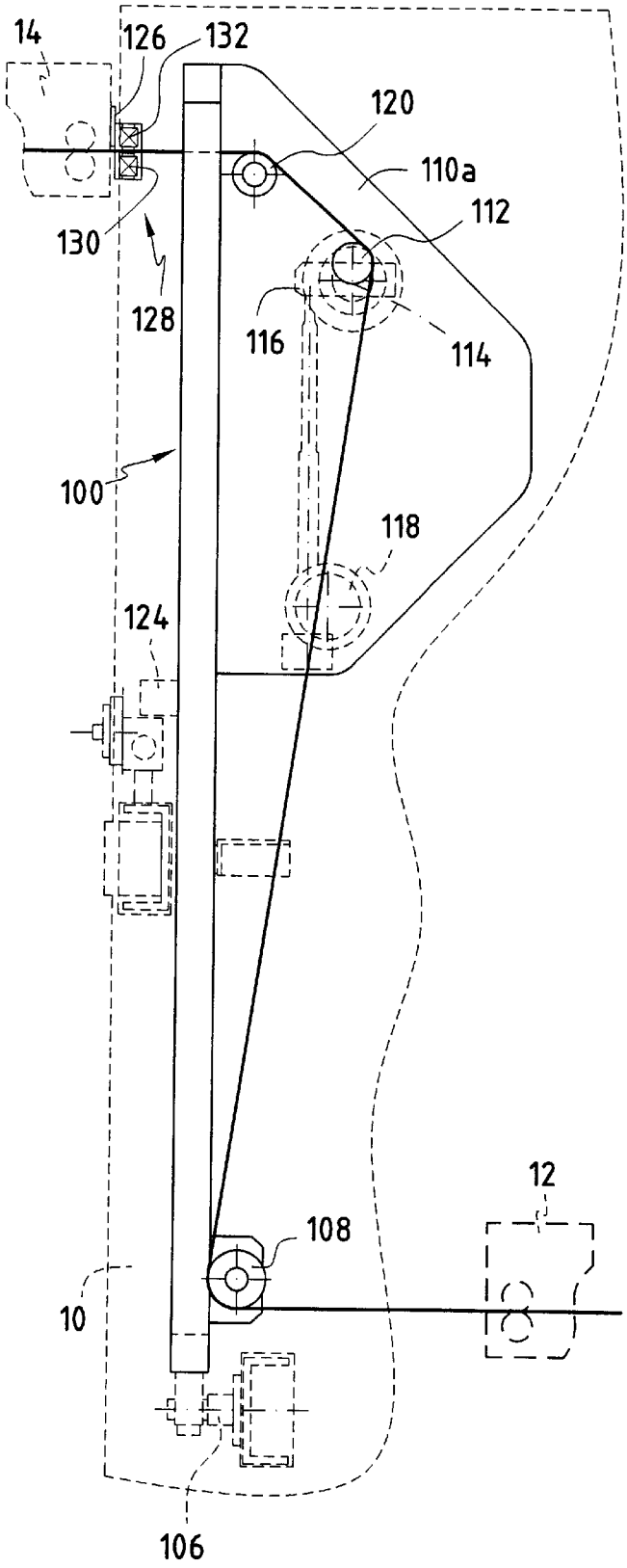
FIG. 2 is a diagrammatic side view of apparatus of the invention for automatically controlling the spreading of a textile sheet.

Apparatus for automatically presenting a generally pre-needled textile sheet is shown diagrammatically in FIGS. 1 and 2. It is placed between a pre-needling module 12 and a cross-layer 14. Nevertheless, such apparatus can also be placed between a tow feed module and a cross-layer.

This automatic apparatus comprises a frame 100 for supporting a textile sheet while it passes through the apparatus and comprising two side uprights 102*a*, 102*b* interconnected by two end cross-members 104, 104*b*. The support frame is hinged to a structure of the apparatus about a hinge axis 106 which is fixed to one of the cross-members, advantageously the upstream cross-member 104*a*.

A first deflector roller 108 is mounted on an upstream portion of the support frame between the two side uprights 102*a*, 102*b* to provide first guidance for the textile sheet arriving from the upstream module 12, the tow feed module, or a pre-needling module.

On an opposite front portion of the support frame, and on either side thereof, there are fixed two side cheek plates

110*a*, 110*b* having mounted between means for adjusting the width of the textile sheet and formed by an adjustment bar 112 that can be pivoted about an axis 114 with pivoting of the bar being controlled by a lever arm 116 driven by a first actuator 118, preferably an electrically controlled actuator, mounted on a side upright 102*b* of the support frame. Slightly offset downstream from said adjustment bar, there is disposed a second deflector roller 120 between the two side cheek plates for guiding the textile sheet leaving the apparatus 10 towards the cross-layer 14.

The moving adjustment bar is a curved bar that is generally banana shaped and when it is pivoted about its pivot axis under drive from the first actuator (via the lever arm) it has the effect of modifying the position of the curvature of its central portion which, by going from a concave shape to a convex shape acts on the width of the textile sheet passing over said curved bar. Thus, a convex position corresponds to a width that is greater than the width which corresponds to a concave position.

In addition to means for adjusting the width of the textile sheet, the apparatus of the invention also has means for adjusting the position of the textile sheet, said means being constituted by a second actuator 122, preferably electrically controlled, acting on a central cross-member 124 interconnecting the two side uprights 102*a*, 102*b* so as to displace the support frame 100 about its hinge axis 106. By means of this displacement, it is possible to modify the position of the longitudinal center axis of the textile sheet and thus to control accurately where it enters the cross-layer. The second actuator 122 is secured to the structure of the apparatus on which it is mounted.

Figure 3:
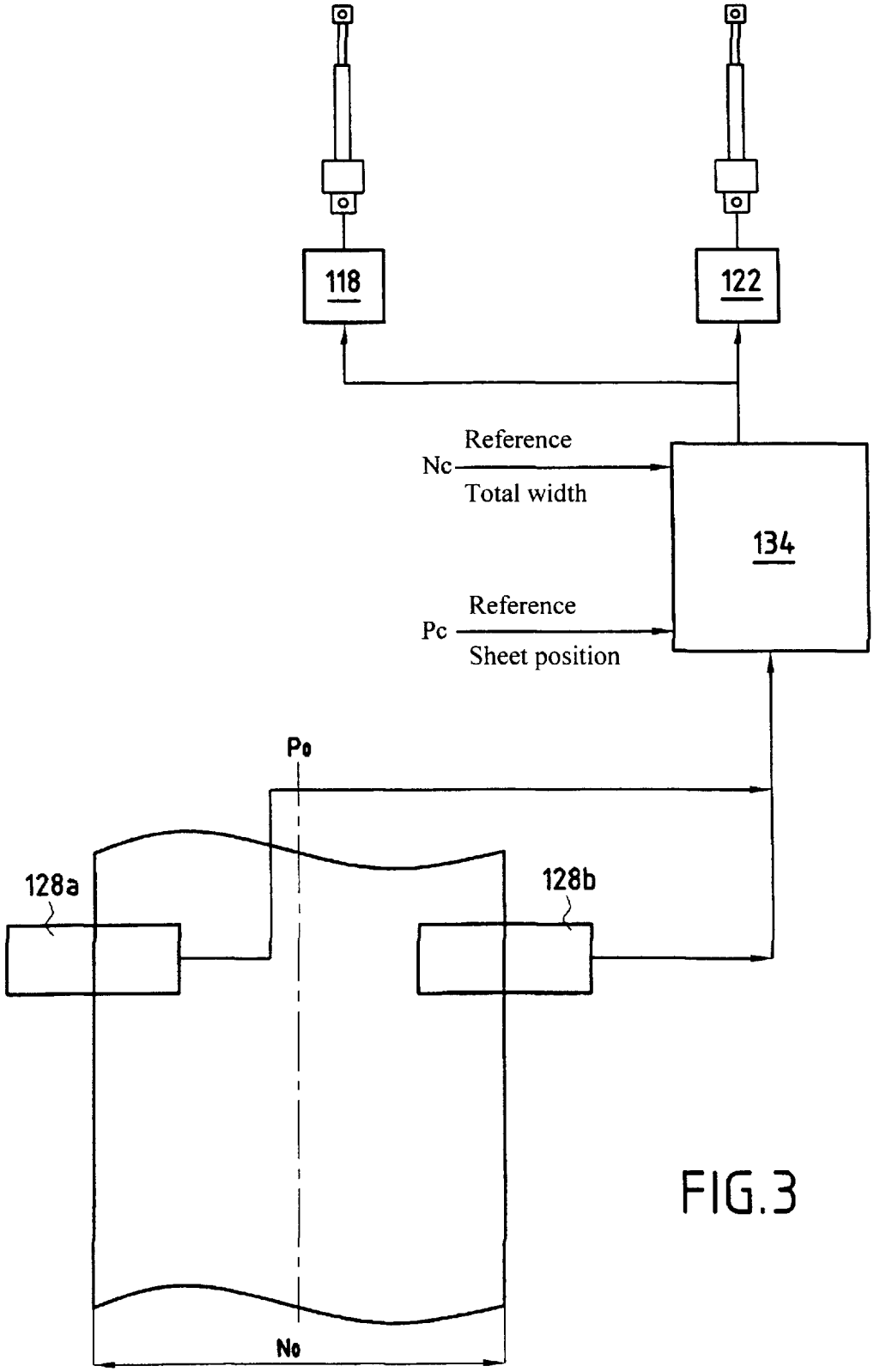
FIG. 3 shows the processor means for automatically controlling the apparatus of the invention.

The width and the position of the textile sheet are controlled by means for measuring the positions of the longitudinal edges of said sheet that are formed by a detector mounted on a support 126 placed in a fixed position at the outlet from the apparatus 10, as shown, or at the inlet of the cross-layer 14. This detector is advantageously constituted by a linear optical sensor (preferably an infrared light strip) formed by a plurality of light-emitting diodes 130 placed in register with a plurality of light-receiving diodes 132, and with the textile sheet to be measured passing between them. Given the dimensions of the textile sheet, this detector is advantageously made up of two sensors 128*a* and 128*b* each mounted so as to detect one of the longitudinal edges of the textile sheet, as shown in FIG. 3. Nevertheless, it should be observed that it is possible advantageously to replace this detector by a single digital camera placed above the textile sheet so as to cover the entire width of the sheet.

Automatic control is provided by processor means, preferably a digital computer or a programmable controller 134, which receives the position information from the detectors 128*a*, 128*b* and responds to said information by actuating the two electrically controlled actuators 118, 122 so as to control the displacement of the bar for adjusting the width of the textile sheet 112 and the displacement of the support frame 100. The digital processor means operates in real time to provide regulation relative to two independent reference values: the desired total width for the sheet (reference total width Nc) and the desired position for the longitudinal center axis of the sheet (reference position Pc) so as to ensure that the textile sheet is centered particularly accurately. These two reference values are initially supplied to the processor means by an operator of the apparatus.

The apparatus 10 operates as follows. It is naturally assumed that a non-centered textile sheet of width that a priori need not be compliant is initially extracted from the upstream module 12, e.g. a pre-needling module, and that the pre-needled textile sheet is then inserted into the cross-layer 14, which also drives the sheet.

In the apparatus of the invention, the textile sheet thus passes in succession over the first deflector roller 108 then over the moving adjustment bar 112 whose initial position is such as to present curvature in compliance with the reference values, and finally over the second deflector roller 120. In this initial position, i.e. before the textile sheet has begun to be driven continuously, the detector 128*a*, 128*b* provides precise information concerning the exact coordinates of the sheet, relative to a predetermined fixed frame of reference, and it will then continue to monitor the position. These coordinates are the coordinates of the two longitudinal edges of the textile sheet, from which it is possible to deduce an initial value N0 for the total width of the sheet and an initial value P0 for the position of its longitudinal center axis. By comparing these initial values, and the values Ni, Pi as measured subsequently while the sheet is advancing (in a predetermined time period), with the predetermined reference values, the processor means 134 can perform regulation.

This real-time regulation takes place relative to the two reference values and no particular priority order is defined between them. The position of the textile sheet is controlled immediately, whereas the width of the sheet is controlled with a time delay due to the time taken by the textile sheet to spread after the curved adjustment bar has pivoted.

What is claimed is:

1. Apparatus if or automatically presenting a generally pre-needled textile sheet from an upstream module to feed a cross-layer module, the apparatus comprising means for measuring the positions of the longitudinal edges of said textile sheet, means for adjusting the width of said textile sheet, means for adjusting the position of said textile sheet, and processor means for responding to said position measuring means to control said adjustment means in real time in such a manner that said textile sheet is presented with a determined width and is located at a given position.

2. Apparatus according to claim 1, wherein said means for measuring the positions of the longitudinal edges of said textile sheet comprise at least one detector, preferably a linear optical sensor made up of a plurality of light-emitting diodes disposed in register with a plurality of light-receiving diodes, and with the textile sheet to be measured passing between them.

3. Apparatus according to claim 2, having two detectors each disposed at a respective longitudinal edge of said textile sheet.

4. Apparatus according to claim 1, wherein said means for measuring the positions of the longitudinal edges of said textile sheet comprise a digital camera placed above said textile sheet.

5. Apparatus according to claim 1, wherein said means for adjusting the width of said textile sheet comprise a curved adjustment bar whose pivoting about a pivot axis is controlled by means of a lever arm by a first actuator, thereby having the effect, when modifying the position of the curvature of the central portion of said curved adjustment bar, of acting on the width of said textile sheet passing over said curved adjustment bar.

6. Apparatus according to claim 1, wherein said means for adjusting the position of said textile sheet comprise a second actuator acting on a support frame for supporting the textile sheet so as to move the frame relative to the structure of the apparatus.

7. Apparatus according to claim 5, wherein said first and second actuators are electrically controlled actuators being actuated directly by said processor means.

8. Apparatus according to claim 2, wherein said first and second actuators are electrically controlled actuators being actuated directly by said processor means, and wherein said processor means comprise a digital computer or a programmable controller responsive to said measurements taken by said position detectors to control said first and second actuators for adjusting the width and the position of said textile sheet in such a manner as to regulate the width and the position of said textile sheet in real time relative to predetermined reference values previously supplied to said processor means by an operator.

9. Apparatus according to claim 8, wherein said predetermined reference values comprise the total width of the sheet Nc and the position of the longitudinal center axis of the sheet Pc.

10. A method of automatically presenting a textile sheet, said method comprising the steps of:

measuring the positions of the longitudinal edges of said textile sheet using first detectors;

deducing a value Pi for the position of the longitudinal center axis of said textile sheet and a value Ni for the total width of said textile sheet using a digital computer or a programmable controller;

comparing said measured values with corresponding predetermined reference values Pc, Nc using said computer or programmable controller; and controlling the width and the position of said textile sheet using actuators so as to cause the measured values to be matched in real time to the reference values in such a manner that said textile sheet is presented with a determined width and is located at a given position.

* * * * *

UNITED STATES PATENT AND TRADEMARK OFFICE

CERTIFICATE OF CORRECTION

PATENT NO. : 6,690,987 B2
DATED : February 10, 2004
INVENTOR(S) : Yvan Baudry et al.

It is certified that error appears in the above-identified patent and that said Letters Patent is hereby corrected as shown below:

Title page,
Item [75], Inventors, "Yvon Baudry" should read -- Yvan Baudry --
Item [75], *Attorney, Agent, or Firm,* "Lebovoici" should read -- Lebovici --; and Column 4,
Line 30, "if or" should read -- for --.

Signed and Sealed this

Fifteenth Day of March, 2005

JON W. DUDAS
*Director of the United States Patent and Trademark Office*